US006123150A

United States Patent [19]

McGarian et al.

[11] Patent Number: 6,123,150

[45] Date of Patent: Sep. 26, 2000

[54] BRANCH BOREHOLES

[76] Inventors: Bruce McGarian, 23 East Glebe, Stonehaven, Aberdeen, AB3 3HW; Ronald James Bruce, Morven View, Lumphanan, Aberdeen AB31 4QB, both of United Kingdom

[21] Appl. No.: 08/981,649

[22] PCT Filed: Jul. 17, 1996

[86] PCT No.: PCT/GB96/01713

§ 371 Date: Jan. 8, 1998

§ 102(e) Date: Jan. 8, 1998

[87] PCT Pub. No.: WO97/04208

PCT Pub. Date: Feb. 6, 1997

[30] Foreign Application Priority Data

| | | | |
|---|---|---|---|
| Jul. 17, 1995 | [GB] | United Kingdom | 9514569 |
| Feb. 14, 1996 | [GB] | United Kingdom | 9603013 |
| Apr. 16, 1996 | [GB] | United Kingdom | 9607873 |

[51] Int. Cl.[7] ..... E21B 7/08

[52] U.S. Cl. ..... 166/313; 166/50

[58] Field of Search ..... 166/50, 313, 384, 166/117.5, 117.6

[56] References Cited

U.S. PATENT DOCUMENTS

| | | | |
|---|---|---|---|
| 5,113,938 | 5/1992 | Clayton | 166/117.6 |
| 5,115,872 | 5/1992 | Brunet et al. | 166/50 X |
| 5,289,876 | 3/1994 | Graham | 166/276 |
| 5,301,760 | 4/1994 | Graham . | |
| 5,398,754 | 3/1995 | Dinhoble | 166/117.6 |
| 5,458,209 | 10/1995 | Hayes et al. | 166/117.5 X |
| 5,477,925 | 12/1995 | Trahan et al. | 166/382 |
| 5,551,509 | 9/1996 | Braddick | 166/55.7 |
| 5,816,324 | 10/1998 | Swearingen et al. | 166/117.5 |

FOREIGN PATENT DOCUMENTS 0701045 3/1996 European Pat. Off. .

OTHER PUBLICATIONS

International Pub. No., WO 94/0924 to Curtis Blount et al. entitled, "Method for Forming a Window in a Subsurface Well Conduit," dated Apr. 28, 1994.

*Primary Examiner*—Frank Tsay

*Attorney, Agent, or Firm*—Watson Cole Grindle Watson, P.L.L.C.

[57] ABSTRACT

A method of forming and lining a branch borehole includes installing a packer in a main borehole, installing a whipstock on the packer, milling a window in the main borehole casing using the whipstock, recovering the whipstock, and then installing a deflector (20) to deflect a lining into the lateral. The external diameter (D) of the deflector is less than the internal diameter of the casing of the main borehole so as to permit subsequent milling away of cement and surplus lining material using a washover tool or thin-walled mill. The preferred deflector includes a relatively steep deflector face (21) at the upper end of the deflector and a relatively shallow deflector face (22) which connects the lower end (23) of the face (21) to the full diameter (D) of the deflector. If it is desired to use the maximum possible diameter casing for the lateral, portions of the formation and/or the main borehole casing are removed by an appropriate tool after the deflector (20) has been positioned within the borehole.

9 Claims, 5 Drawing Sheets

BRANCH BOREHOLES

BACKGROUND OF THE INVENTION

1. Field of the Invention

This invention relates to the formation and lining of branch boreholes, that is to say, techniques for use in formation of a borehole which extends as a branch of a main borehole, and the lining of such a branch.

2. The Prior Art

It is well known in the exploitation of oil and gas wells to form one or more branch boreholes, usually known as "laterals", off an existing main borehole. In general, the main borehole extends vertically and the or each lateral diverges from the vertical borehole. However, in some cases the initial main borehole may itself extend at an angle to the vertical.

International patent application WO94/03698 describes various techniques for the formation of laterals. Typically, a fixed support is established in a main borehole somewhat below the level of the proposed lateral. This may conveniently be done by setting an appropriate packer in the main borehole. A whipstock is then run into the main borehole and is appropriately orientated using known techniques. The inclined surface of the whipstock is then used as a guide for one or more milling tools which mill a window in the casing of the main borehole and mill away the surrounding formation until a lateral has been started, and may be continued without milling further casing. The milling tool which has formed the opening may typically be used to continue drilling through the formation if a relatively short lateral is required. In the alternative, the milling tool may be removed and a formation drilling tool run into the well. The formation drilling tool will be guided by the whipstock through the window which has been milled in the main borehole casing and drilling of the lateral with the new tool can commence.

Several techniques have been proposed for formation of the window. For example, it has been proposed to use a starter mill for the purpose of breaking through the casing and to replace the starter mill with a main mill to mill the majority of the window. It has also been proposed to run combination mills through the window, for example an end mill followed by one or more watermelon mills. In each case, however, the intention is to produce a path which is bounded on one side by the face of the whipstock and is of the full gage diameter of the milling assembly. After the lateral has been drilled to the required depth the drilling assembly is removed. A casing may then be run into the lateral. The casing will again be guided by the sloping face of the whipstock and little difficulty should be experienced in guiding the casing through the window which has been formed in the main borehole casing, and into the lateral. The above described technique is satisfactory provided that the whipstock which is used to guide the milling tool is also used to guide the casing into the lateral. There are, however, a number of practical reasons why using the whipstock for this purpose is not wholly desirable.

Firstly, it may well be desirable to recover the whipstock for re-use or to recover the whipstock to re-open the main borehole. Obviously, if the lining installed in the lateral continues upwardly in the main borehole from the window it will not be possible to recover the whipstock after the lateral has been positioned.

Secondly, if the whipstock is used to guide the casing into the lateral there will in general be a relatively large area of sliding contact between the casing and the whipstock. The whipstock face is long and tapers only at a shallow angle. This shallow angle occurs at the point where the casing is deflected from the main borehole into the lateral. Accordingly, there may be substantially full face contact between the casing and at least part of the surface of the whipstock. Such full face contact will impose a substantial frictional drag on the casing and may render it difficult to push the casing into position.

Thirdly, if the casing to the lateral is to be cut away at the point where it enters the main borehole, the presence of the whipstock significantly complicates the cutting operation. Either the casing and the entire whipstock must be milled away by an appropriate milling tool or, if a wash-over tool or thin walled mill is used for cutting the casing, the whipstock must be designed to enter the wash-over tool or thin walled mill as the lateral casing is cut. This imposes design constraints on the whipstock which can reduce its effectiveness in performing its primary function of guiding the mill which opens up the casing window. For example, referring to the technique illustrated in FIGS. 5A–5H of WO94/03698 it will be noted that the whipstock has an external diameter substantially smaller than the internal diameter of the main borehole. The resulting clearance between the whipstock and the casing of the main borehole is used to accommodate a thin walled mill which is used to remove surplus cement and lateral casing. However, the clearance provided between the whipstock and the main borehole casing means that the whipstock is not laterally supported at the upper end thereof. In practice, a whipstock will have a significantly shallower angle relative to the axis of the main borehole than in the schematic illustrations of FIGS. 5A–5H, and accordingly the problem of inadequate support at the upper end of the whipstock will be exacerbated.

SUMMARY OF THE INVENTION

With a view to overcoming the problems outlined above, the present invention provides a technique for the formation and lining of a lateral in which, after the lateral has been bored using a whipstock to guide the milling/boring tool, the whipstock is removed prior to insertion of the lateral casing. In order to guide the lateral, casing from the main borehole into the lateral the whipstock is replaced with a suitable deflector for deflecting the casing from the main borehole into the lateral. The diameter of the main body of the deflector may be smaller than the overall diameter of the whipstock which was used initially, and is somewhat less than the inside diameter of the main borehole casing. If desired, the deflector may be formed with one or more supports which extend outwardly from the main body thereof to engage the casing of the main borehole. If such supports are provided, they can readily be milled away during subsequent removal of the excess casing and cement. The use of such a deflector particularly facilitates the use of a wash-over tool as a means of removing the end portion of the lateral casing which is located in the main borehole.

Whilst the above technique is highly desirable in that it permits removal of the whipstock prior to insertion of the lateral casing, the technique does impose limitations on the diameter of the casing which can be run into the lateral. This is because the casing deflector has a diameter less than the inside diameter of the main borehole casing and accordingly the path along which it can deflect the lateral casing is located somewhat closer to the axis of the main borehole than was the path of the milling tool which formed the windows As a result, if the lateral casing has the maximum nominal diameter which can pass through the main borehole, the casing deflector cannot be positioned at a point which allows the casing to pass through the window and into the lateral.

The above problem can be overcome if a casing is used for the lateral which is smaller than the nominal diameter of the milling tool which was used to form the window opening in the casing. However, if the maximum possible diameter of lateral casing is required the preferred embodiments of the present invention provide three techniques for solving the problem outlined above. In the first of these techniques a casing deflector is positioned in the borehole at a point where it is able to deflect the casing through a window which has previously been formed. At this point, the formation will, however, not have been milled to a sufficient extent to allow the lateral casing to pass. Accordingly, this aspect of the present invention provides that after the casing deflector has been positioned a suitable tool is run into the well and, guided by the casing deflector, mills away the formation on the side of the combined main and lateral borehole which is opposite to the deflector. Removing extra formation at this point is relatively quickly and easily achieved, and once the tool which is being used for this purpose has been removed, and the lateral drilled, the lateral casing may be run into the borehole and, guided by the casing deflector, will pass through the window and into the lateral.

In the second technique the casing deflector is positioned at a point where there is sufficient clearance in the lateral to allow the lateral casing to be deflected into the lateral, but where the previously formed window is insufficiently broad to allow the lateral casing to pass. Having positioned the casing deflector a suitable tool is run into the well to open up the window at this point, and after the tool has been removed, and the lateral drilled, the lateral casing is run in to be guided by the casing deflector through the widened window into the lateral.

In the third technique a deflector is used in which the deflector face is made up of at least first and second deflector face portions, the first deflector face portion extending downwardly from the upper extremity of the deflector at a first relatively large angle to the axis of the deflector and the second deflector face portion extending upwardly from the full diameter of the deflector inwardly towards the axis of the deflector at an angle relative to the axis of the deflector which is less than the angle of the first deflector portion. In the preferred embodiment of the invention the first and second deflector face portions are contiguous. In alternative embodiments, one or more additional deflector face portions interconnect the first and second deflector face portions. If one or more deflector face portions are present between the first deflector face portion and the second deflector face portion the angle which the additional deflector face portions make with the axis of the deflector progressively decreases along the length of deflector face from the upper extremity of the deflector to the full diameter thereof.

BRIEF DESCRIPTION OF THE DRAWING

The invention will be better understood from the following description of preferred embodiments thereof, given by way of example only, reference being had to the accompanying drawings wherein.

DETAILED DESCRIPTION OF THE PREFERRED EMBODIMENTS

Figure 1:
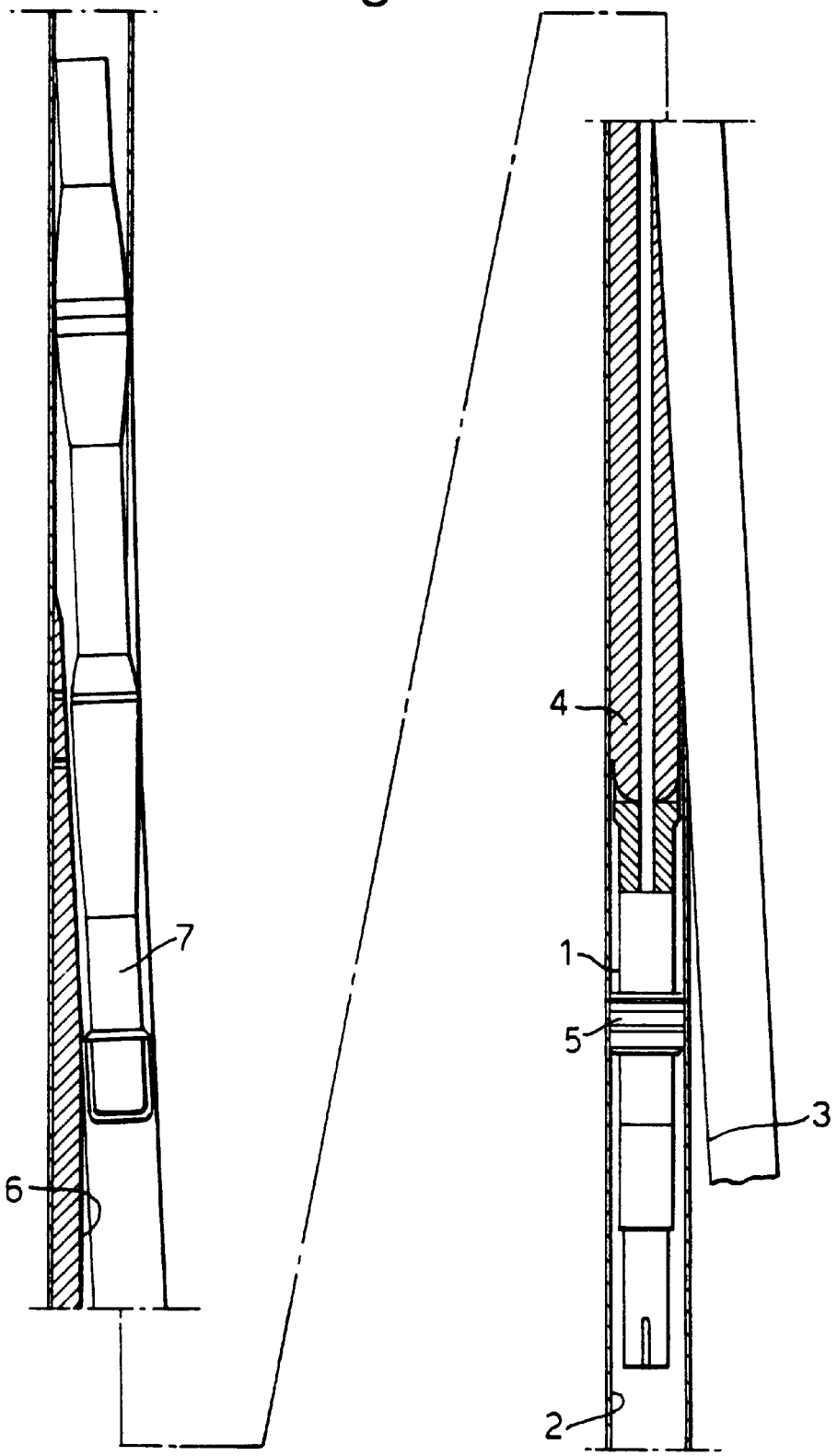
FIG. 1 illustrates schematically the formation of a lateral using a milling tool guided by a whipstock.

Referring firstly to FIG. 1 there is shown a borehole 1 which is lined with a conventional steel casing 2. A suitable support, e.g., an anchor or anchor packer (not shown), is set in the casing 2 to provide a fixed support for the formation of a lateral 3. A whipstock 4 is supported via appropriate subs including a debris collector 5 on the packer and provides a guide face 6 for guiding a milling tool 7. The exact form of the milling tool is not critical to the present invention. As will be appreciated by those skilled in the art, the required lateral is formed by milling away the casing 2 to form a window and then drilling into the surrounding formation. This will have the effect of producing a passage of which one side is formed by the whipstock face 6, the diameter of the passage corresponding to the gage diameter of the milling/drilling system. As will be appreciated by those skilled in the art, during the milling operation the upper end of the whipstock 4 rests against the casing 2 and the overall diameter of the whipstock is the maximum which can be accommodated by the casing 2 in order to provide the maximum rigidity for the whipstock and the maximum support for the milling tool 7.

As mentioned above, if a casing is run into the lateral 3 along the whipstock face 6, no particular problems arise. However, this precludes removal of the whipstock, which gives rise to well known problems.

Figure 2:
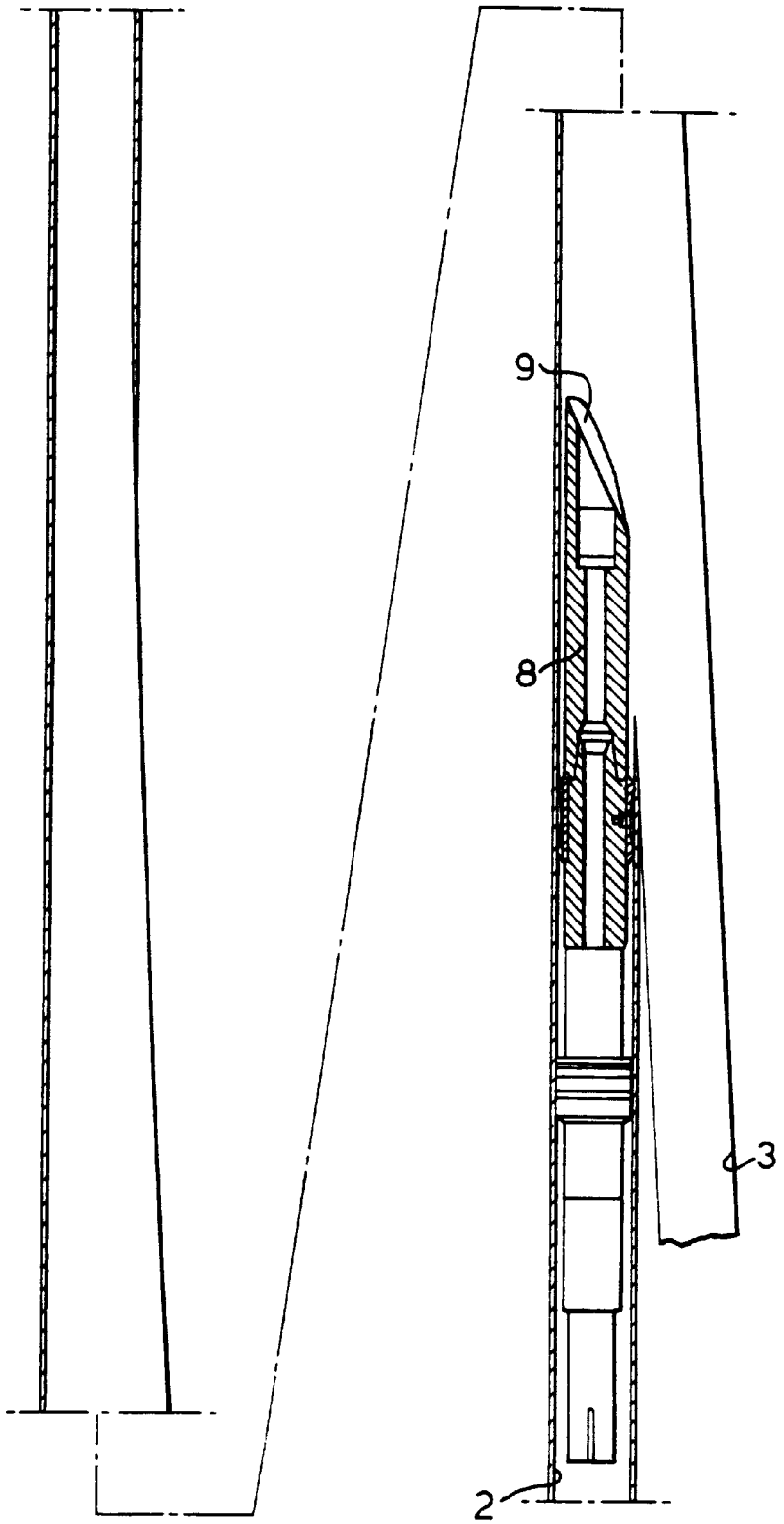
FIG. 2 shows a casing deflector positioned in the well of FIG. 1 after the whipstock has been removed.

Accordingly, after the lateral 3 has been bored to the required depth, the whipstock is preferably removed and replaced by a casing deflector 8 as illustrated in FIG. 2. The casing deflector has a relatively short deflector face 9 and has an outside diameter which is less than that of the casing 2. Accordingly, an annular clearance space exists around the deflector 8. This clearance space facilitates the use of a wash-over tool to mill away the lateral casing which remains in the main borehole after the casing has been run to the required depth into the lateral. Although, as illustrated, there is a complete clearance space around the deflector 8, it should be appreciated that if desired one or more relatively small supports may be provided, e.g. at the upper end of the deflector, in order to engage the casing wall and provides support for the deflector at this point. If such supports are used, they will be made as relatively small projections from the main body of the deflector and will be milled away during subsequent recovery operations.

Figure 3:
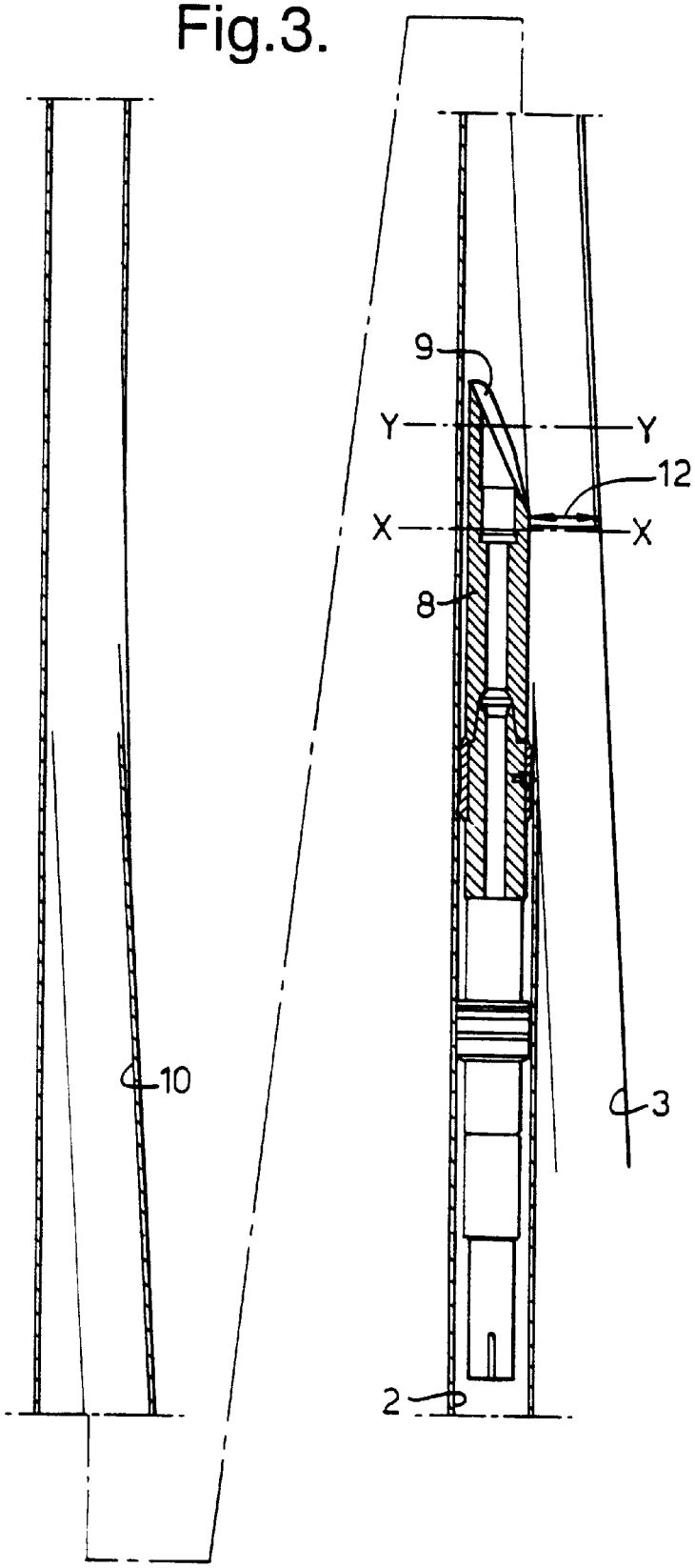
FIG. 3 illustrates the problem of deflecting a casing into the lateral with the casing deflector at the position illustrated in that figure.
Figure 3A:
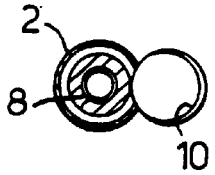
Figure 3B:
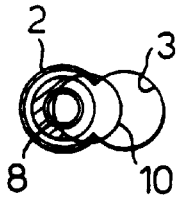

Referring to FIG. 3, the problem of trying to deflect a lateral casing 10 into the lateral 3 using the deflector 8 is illustrated. If the casing could be brought to the position illustrated in which the left hand lower edge of the casing (as illustrated in FIG. 3) is resting on the outside diameter of the deflector 8, there would be adequate clearance for the casing as illustrated by FIG. 3A which is a cross-section on the line X—X of FIG. 3. However, the lateral casing 10 cannot be brought to this position by running the leading edge of the casing up the inclined face 9 of the deflector 8. This is because the width of the casing window at cross-sectional point Y—Y is insufficient to accommodate the diameter of the lateral casing 10 which will be presented at that point—see FIG. 3B which illustrates a true cross-section on the line Y—Y with, superimposed on it, the position which the leading end of the lateral casing 10 would occupy if it were to be resting on the inclined face 9 in the section Y—Y. It will be seen that the casing diameter at the window is larger than the window opening at this point.

Figure 4:
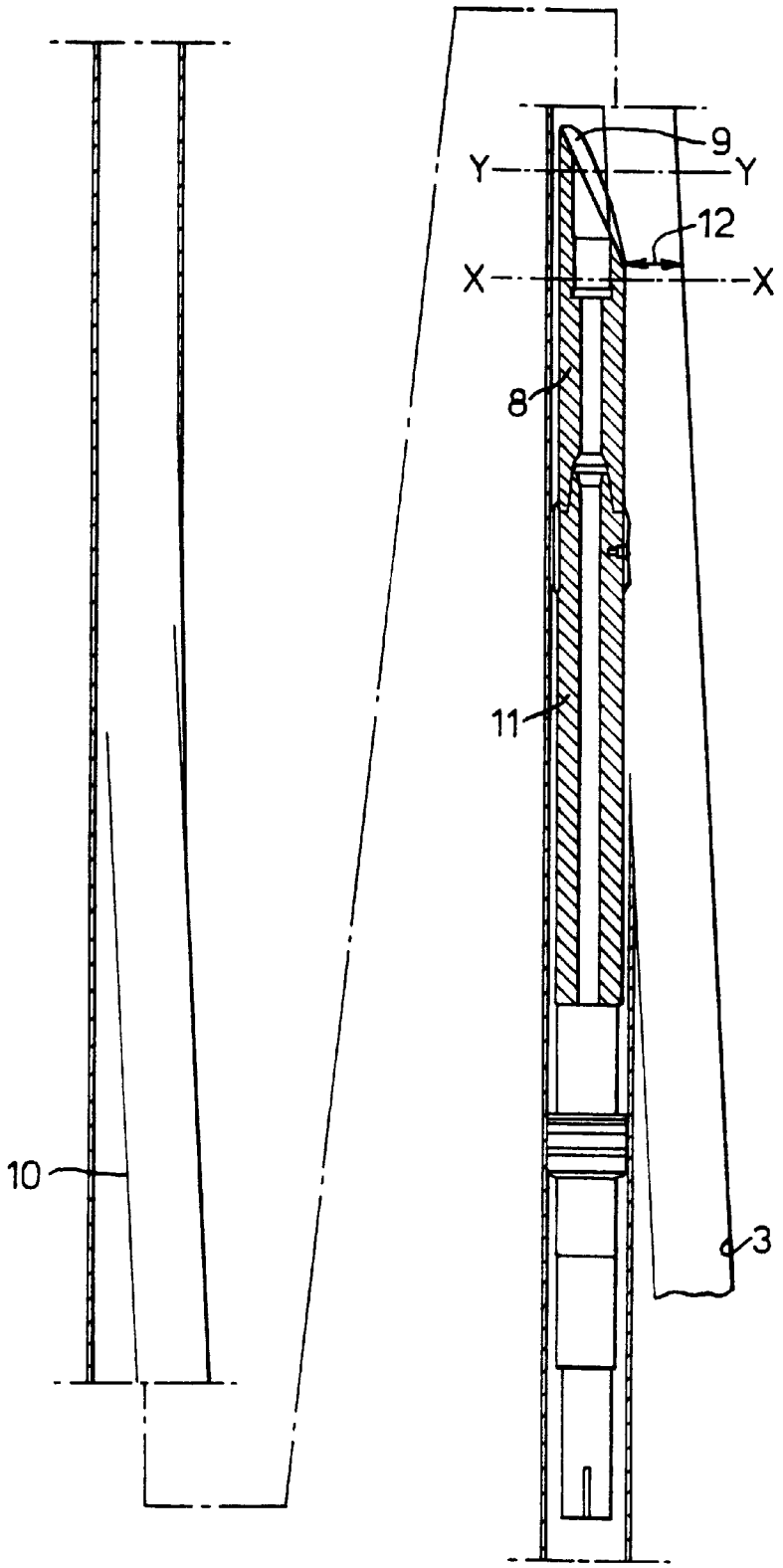
FIG. 4 illustrates an alternative position for a casing deflector.
Figure 4A:
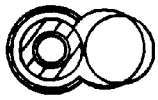
Figure 4B:
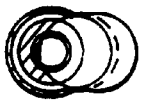
Figure 5:
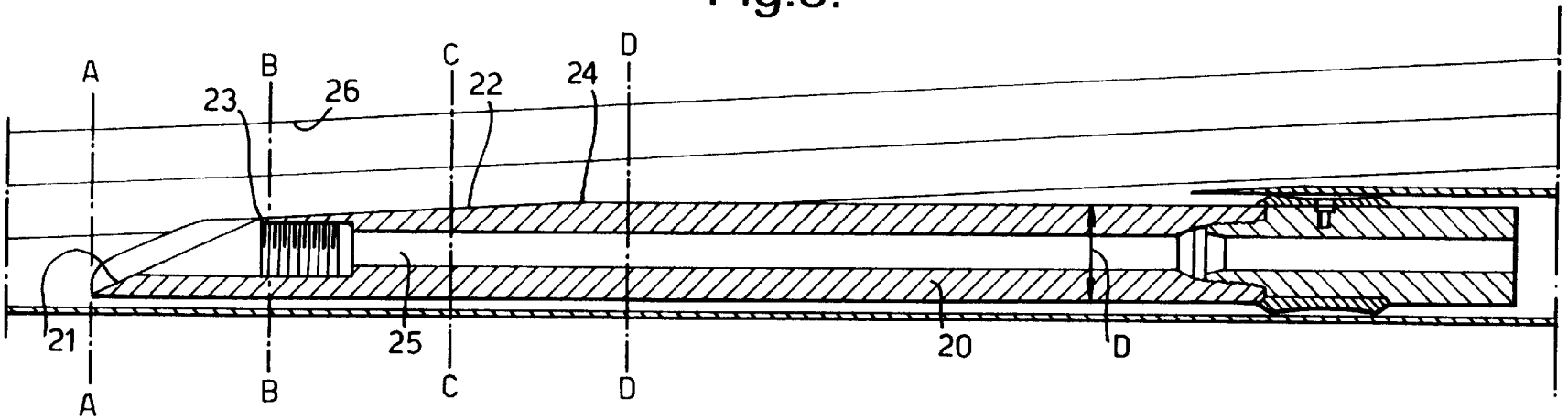
FIG. 5 illustrates an alternative deflector.
Figure 5D:
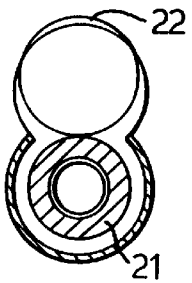
FIGS. 5A, 5B, 5C and 5D are schematic cross sections of FIG. 5 on the lines illustrated.
Figure 5C:
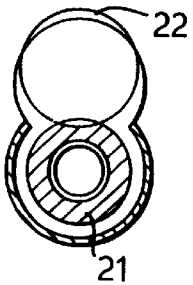
Figure 5B:
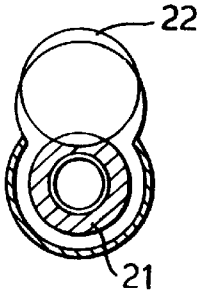
Figure 5A:
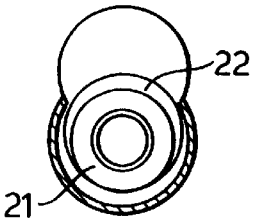

One apparent solution to this problem is to position the deflector face 9 further up hole by insertion of a suitable sub 11 below the casing deflector 8. This arrangement is illustrated in FIG. 4. It will be seen in this case that although the window opening is sufficiently large to permit passage of the casing (FIG. 4B) there is insufficient clearance 12 at the point where the inclined face 9 meets the full diameter of the deflector 8 (FIG. 4A) to allow for passage of the casing 10. Thus, although positioning the deflector 8 as illustrated in FIG. 4 will allow the lateral casing to pass through the window, the casing will immediately foul on the face of the lateral 3 and further movement of the casing will be prevented.

With a view to overcoming the problems outlined above, the preferred embodiment of the present invention offers three possible courses of action.

Firstly, if the deflector 8 is positioned generally as illustrated in FIG. 3, that is, at a point where the clearance 12 between the full diameter of the deflector 8 and the opposite wall of the lateral 3 is sufficient to accommodate the casing 10, the portions of the casing 2 which would prevent passage of the casing 10 along the face 9 of the deflector are removed by using a suitable tool. For example, a suitable milling tool is run into the well and deflected along the face 9 to mill away the edges of the casing 2 which define the window to an extent sufficient to provide a clearance passage for the casing 10 as it runs up the face 9.

An alternative solution is to position the deflector 8 at the position illustrated in FIG. 4, i.e., at a position where passage of the lateral casing 10 through the window as the casing runs up the face 9 is accommodated by the window which has been milled using the standard milling technique of FIG. 1, and then to run a suitable tool into the well to mill away the formation opposite the lower end of the face 9 to increase the clearance 12 to a value sufficient to accommodate the lateral casing 10. Such a tool can run along the face 9 through the window which has been milled previously to engage the formation and mill away formation as necessary. The tool may then be removed and the casing 10 run along the face 9 through the window and through the newly opened clearance 12 into the lateral 3.

Either of the techniques described above overcomes the difficulties associated with the prior art. However, it is at present believed that the technique which involves milling away the formation to open up the clearance 12 is preferred to the technique of milling away the casing 2 to open up the window which has previously been formed.

Referring now to FIGS. 5 and 5A–5D, an alternative solution to the problem outlined above is provided by the deflector 20 which has a deflector face made up of a first deflector face portion 21 and a second deflector face portion 22. The first deflector face portion extends from the upper extremity of the tool to a point 23 where it joins the second deflector face portion 22. The second deflector face portion 22 extends from the point 23 to the full diameter of the deflector 20 at the point 24. The deflector 20 is positioned, relative to the previously milled casing window, such that the lateral casing guided along the deflector face portions 21 and 22 can pass through the previously milled main bore casing window. To this extent, the arrangement of FIG. 5 corresponds to the arrangement of FIG. 4. However, by splitting the deflector face into first and second portions of which the first portion extends at a greater angle relative to the axis 25 of the deflector than that of the second portion, the degree of interference between the lateral casing and the formation wall 26 opposite to the deflector face is substantially reduced. Accordingly, relatively little formation must be removed in order to allow the lateral casing to enter the lateral guided by the deflector faces 21, 22. The relatively small amount of formation which must be removed can readily be removed by an appropriate tool string, for example including one or more water melon mills, prior to insertion of the lateral.

Regardless of which of the above techniques is used for the purposes of positioning the lateral casing within the lateral, completion of the lateral is effected subsequent to positioning of the casing by cementing the casing into place. More particularly, the length of lateral casing used is selected such that a portion of the lateral casing will remain in the main borehole after the lateral casing has fully entered the lateral. Conventional techniques are then used to cement around the lateral casing, at least in the zone of the lateral adjacent the main borehole and around the portion of the lateral casing in the main borehole adjacent the lateral. In other words, the zone of the juncture between the main borehole and the lateral is cement from a level above the point where the lateral deviates from the main borehole to a point along the lateral from the main borehole.

An appropriate tool, for example a washover tool or thin walled mill, is then run into the main borehole and is used to remove an annular zone of material having an external diameter equal to the internal diameter of the main borehole casing 2. The material removed will consist of the cement which is in the main borehole, the lining material at the point where it passes through the window in the casing 2, and any support members associated with the deflector. The deflector itself, having a smaller diameter than the casing, will be accommodated within the washover/thin walled mill tool. Once milling of the annular zone has been completed the washover tool or thin walled mill can be removed taking with it the portion of the lateral liner which remained in the main borehole at the commencement of the cementing operation. The deflector, and if desired the packer below it, can then be removed using conventional techniques. The result will be that the full diameter of the main borehole will be reopened to allow the passage of tools past the lateral. At the same time, the internal diameter of the lateral casing will be the maximum possible, given the constraint that the external diameter of the lateral casing must be a clearance fixed within the casing of the main borehole.

We claim:

1. A method of forming and lining a branch borehole comprising the steps of: positioning a support in a main borehole at a point below a location at which a branch borehole is to be formed; supporting a whipstock on the support; milling a window in a casing of the main borehole and starting the branch using a milling tool which is guided by the whipstock; removing the whipstock; installing a deflector on the support, the deflector having a main body with a diameter less than the internal diameter of the main borehole casing; drilling the branch to the required depth; running a casing into the branch by deflecting the casing from the main borehole using the deflector until the casing is at a position in which a first portion of the casing is in the branch and a second portion of the casing is in the main borehole; cementing around said portions of the casing; removing an annulus of material from the main borehole so as to sever the casing and the cement at the juncture of the main borehole and the branch; and removing the deflector from the main borehole to re-open the main borehole past the branch.

2. A method of forming and lining a branch borehole according to claim 1 comprising removing material from the main borehole casing or from the formation after the deflector has been positioned but before the casing of the branch borehole is installed.

3. A method of forming and lining a branch borehole according to claim 1 wherein the deflector is positioned such that the casing of the branch borehole passes through the window formed by the mill and comprising the additional step of removing formation from the wall of the branch borehole in the zone of the window after the deflector has been installed to permit passage of the casing into the branch.

4. A method of forming and lining a branch borehole according to claim 1 wherein the deflector is positioned such that there is clearance in the branch to permit passage of the casing of the branch borehole as it enters the branch comprising the additional step of enlarging the window by removing extra casing from the main borehole after the deflector has been installed to permit passage of the casing into the branch.

5. A method of forming and lining a branch borehole according to claim 1, wherein the deflector has a deflecting face comprising a first deflecting face portion which extends downwardly from the upper extremity of the deflector at a first relatively larger angle to the axis of the deflector and a second deflecting face portion which extends upwardly from the full diameter of the deflector inwardly towards the axis of the deflector at an angle relative to the axis of the deflector which is less than the angle of the first deflecting face portion.

6. A method of forming and lining a branch borehole according to claim 5 wherein the first and second deflecting face portions are contiguous.

7. A method of forming and lining a branch borehole according to claim 2 wherein the deflector has a deflecting face comprising a first deflecting face portion which extends downwardly from the upper extremity of the deflector at a first relatively larger angle to the axis of the deflector and a second deflecting face portion which extends upwardly from the full diameter of the deflector inwardly towards the axis of the deflector at an angle relative to the axis of the deflector which is less than the angle of the first deflecting face portion.

8. A method of forming and lining a branch borehole according to claim 3 wherein the deflector has a deflecting face comprising a first deflecting face portion which extends downwardly from the upper extremity of the deflector at a first relatively larger angle to the axis of the deflector and a second deflecting face portion which extends upwardly from the full diameter of the deflector inwardly towards the axis of the deflector at an angle relative to the axis of the deflector which is less than the angle of the first deflecting face portion.

9. A method of forming and lining a branch borehole according to claim 4 wherein the deflector has a deflecting face comprising a first deflecting face portion which extends downwardly from the upper extremity of the deflector at a first relatively larger angle to the axis of the deflector and a second deflecting face portion which extends upwardly from the full diameter of the deflector inwardly towards the axis of the deflector at an angle relative to the axis of the deflector which is less than the angle of the first deflecting face portion.

* * * * *

UNITED STATES PATENT AND TRADEMARK OFFICE

CERTIFICATE OF CORRECTION

PATENT NO. : 6,123,150

DATED : September 26, 2000

INVENTOR(S) : Bruce McGARIAN et al.

It is certified that error appears in the above-identified patent and that said Letters Patent are hereby corrected as shown below:

In the heading:

[73] Assignee: Smith International, Inc.
Houston, Tex.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*